US011815833B2

(12) United States Patent
Jang et al.

(10) Patent No.: US 11,815,833 B2
(45) Date of Patent: Nov. 14, 2023

(54) HEAT CONDUCTION MEMBER FOR PREVENTING FUSER HEATER FROM OVERHEATING

(71) Applicant: HEWLETT-PACKARD DEVELOPMENT COMPANY, L.P., Spring, TX (US)

(72) Inventors: Jaehyeok Jang, Seongnam-si (KR); Sunhyung Lee, Seongnam-si (KR); Hojin Ryu, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/908,953

(22) PCT Filed: Feb. 3, 2021

(86) PCT No.: PCT/US2021/016292
§ 371 (c)(1),
(2) Date: Sep. 2, 2022

(87) PCT Pub. No.: WO2021/183231
PCT Pub. Date: Sep. 16, 2021

(65) Prior Publication Data

US 2023/0087040 A1 Mar. 23, 2023

(30) Foreign Application Priority Data

Mar. 12, 2020 (KR) ..... 10-2020-0030539

(51) Int. Cl.
*G03G 15/20* (2006.01)
*H05B 3/26* (2006.01)

(52) U.S. Cl.
CPC ..... *G03G 15/2017* (2013.01); *G03G 15/2053* (2013.01); *H05B 3/26* (2013.01); *G03G 2215/2016* (2013.01); *H05B 2203/007* (2013.01); *H05B 2203/016* (2013.01)

(58) Field of Classification Search
CPC ..... G03G 15/2017; G03G 15/2042; G03G 15/2053; G03G 2215/2016; G03G 2215/2035; H05B 3/26; H05B 3/34; H05B 2203/007; H05B 2203/016
See application file for complete search history.

(56) References Cited

U.S. PATENT DOCUMENTS

2009/0263171 A1 10/2009 Kageyama
2014/0138372 A1 5/2014 Ogura
2015/0086231 A1 3/2015 Bush et al.
(Continued)

FOREIGN PATENT DOCUMENTS

JP 2009-259714 A 11/2009
JP 2015-129792 A 7/2015
(Continued)

*Primary Examiner* — Sophia S Chen
(74) *Attorney, Agent, or Firm* — Foley & Lardner LLP

(57) ABSTRACT

An example fuser includes a flexible fixing belt, a back-up to form a fixing nip with the fixing belt, a heater substrate having a first surface on which a heating element pattern is located and a second surface opposite to the first surface, the heater substrate to heat the fixing belt at the fixing nip, and a heat conduction member having a plurality of heat conduction segments contacting the first surface of the heater substrate.

13 Claims, 9 Drawing Sheets

(56) References Cited

U.S. PATENT DOCUMENTS

| | | | | |
|---|---|---|---|---|
| 2016/0098001 | A1 | 4/2016 | Ogawa et al. | |
| 2017/0102651 | A1* | 4/2017 | Tanaka | G03G 15/2053 |
| 2019/0278205 | A1 | 9/2019 | Kawaguchi | |
| 2021/0055679 | A1* | 2/2021 | Sato | G03G 15/2042 |

FOREIGN PATENT DOCUMENTS

| | | | |
|---|---|---|---|
| JP | 2016-212211 | A | 12/2016 |
| JP | 2017-072781 | A | 4/2017 |
| JP | 2019-219674 | A | 12/2019 |

* cited by examiner

HEAT CONDUCTION MEMBER FOR PREVENTING FUSER HEATER FROM OVERHEATING

BACKGROUND

A printer using an electrophotographic method supplies toner to an electrostatic latent image formed on an image receptor to form a visible toner image on the image receptor, transfers the toner image to a print medium, and fixes the transferred toner image on the print medium.

The fixing process involves applying heat and pressure to the toner image on the print medium. A fuser may include a heating member and a pressing member to engage with each other to form a fixing nip. The heating member is heated by a heater. The print medium to which the toner image has been transferred is subjected to heat and pressure while passing through the fixing nip, and the toner image is fixed to the print medium.

DETAILED DESCRIPTION OF EXAMPLES

An electrophotographic printer may include a printing unit for forming a visible toner image on a print medium P, for example paper, and a fuser for fixing the toner image to the print medium P. The printing unit may include an exposure unit, a photosensitive drum, a developing unit, a transfer unit, etc. The exposure unit is to irradiate light modulated according to image information on a surface of a photosensitive drum charged with a uniform surface potential to form an electrostatic latent image on the surface of the photosensitive drum. The developing unit is to supply toner to the electrostatic latent image formed on the photosensitive drum to develop the electrostatic latent image into a toner image. The transfer unit is to transfer the toner image formed on the photosensitive drum to the print medium P. The toner image transferred to the print medium P is maintained on the print medium P by an electrostatic force. The fuser is to fix the toner image transferred to the print medium P by applying heat and pressure to the print medium P.

To increase printing speed and reduce energy consumption, a heated member having a small heat capacity may be employed in the fuser. For example, a fixing belt in the form of a thin film may be employed as the heated member. By employing the fixing belt in the form of a thin film, a temperature of the fixing belt may be quickly raised to a fixing temperature, and printing is soon possible after a printer is turned on.

Figure 1:
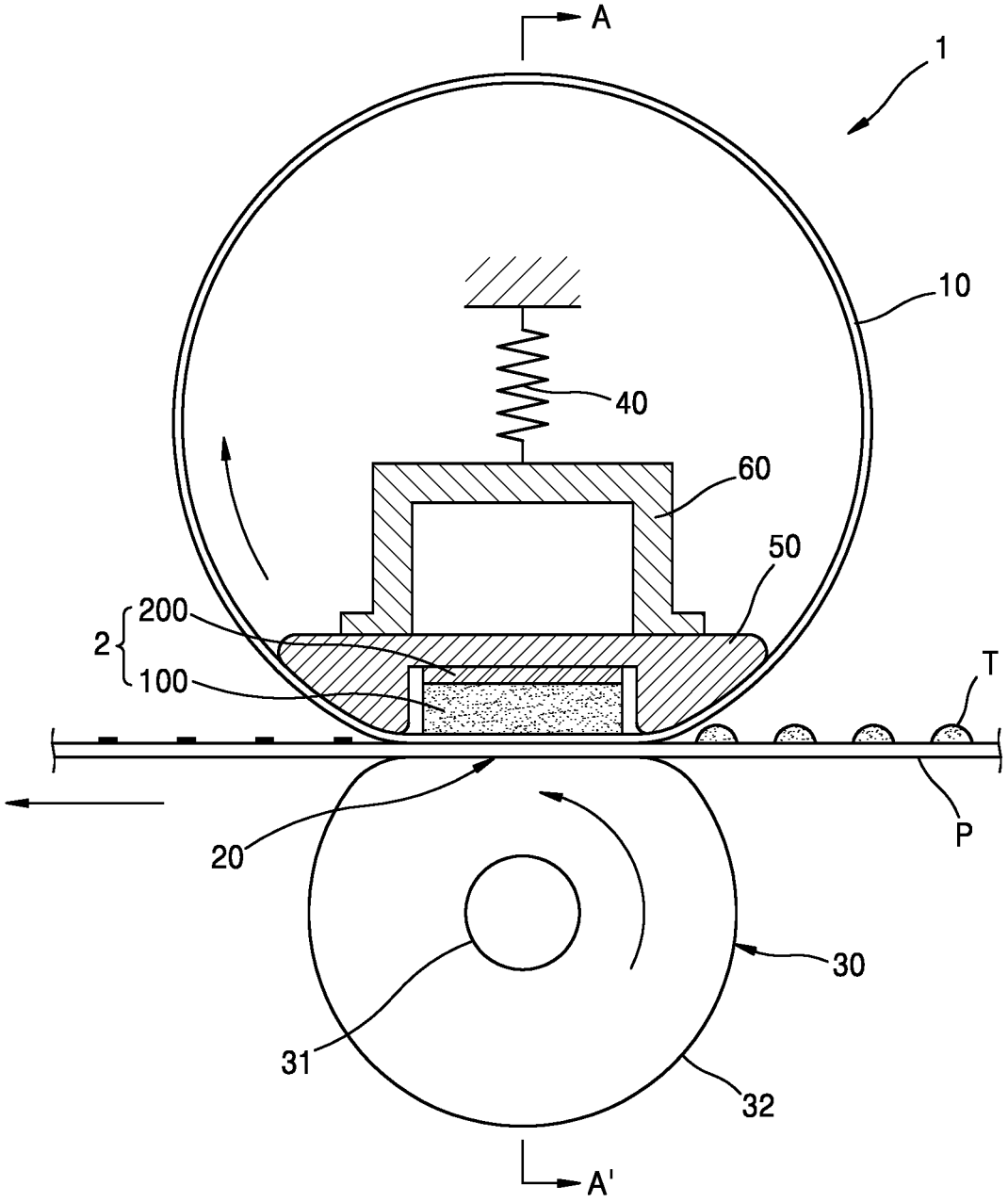
FIG. 1 illustrates a fuser according to an example.
Figure 2:
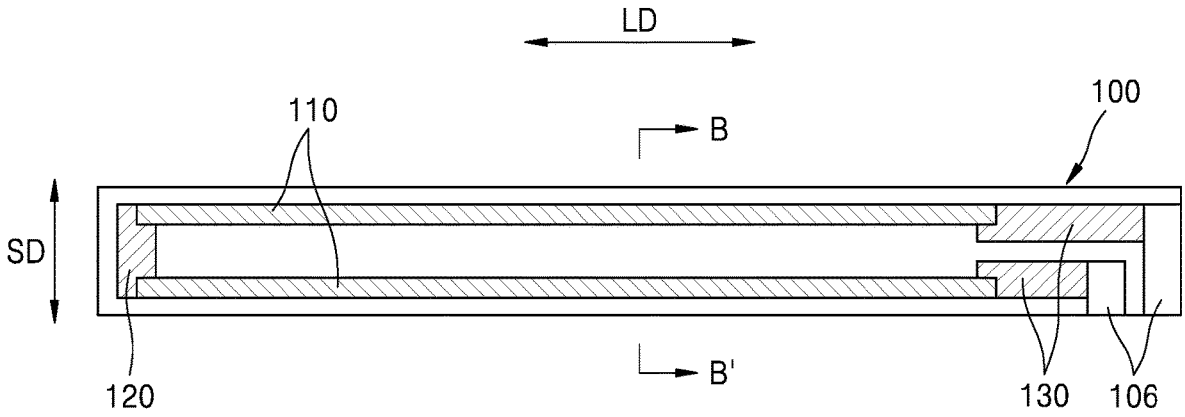
FIG. 2 is a plan view of a heater substrate according to an example.
Figure 3:
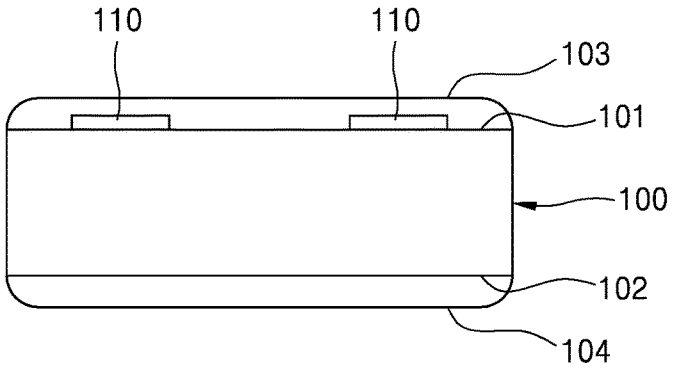
FIG. 3 is a cross-sectional view of the heater substrate taken along a line B-B' of FIG. 2 according to an example.
Figure 4:
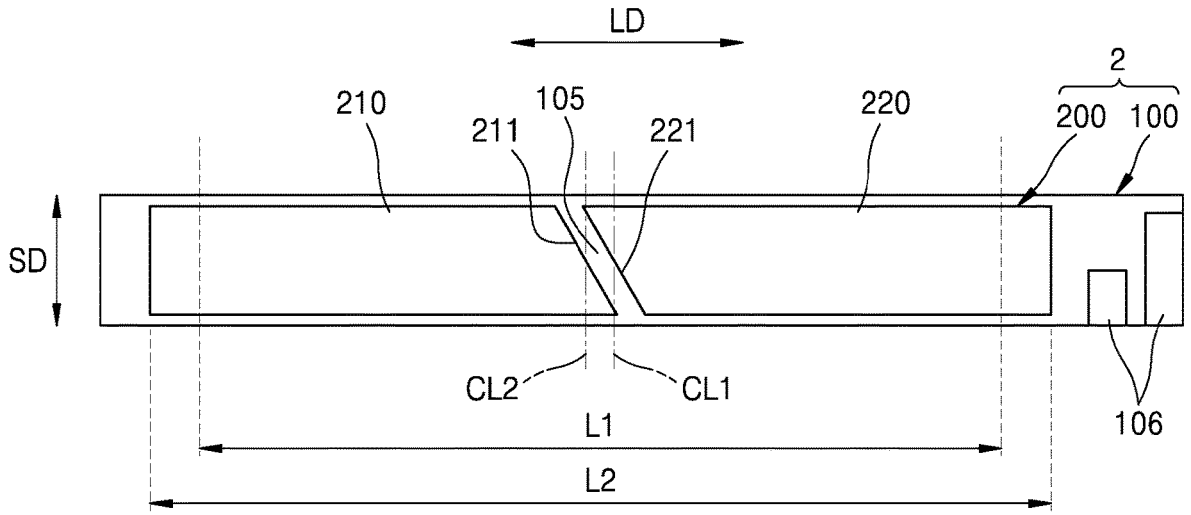
FIG. 4 is a plan view of a plate heater according to an example.

FIG. 1 illustrates a fuser according to an example. FIG. 2 is a plan view of a heater substrate according to an example. FIG. 3 is a cross-sectional view of the heater substrate taken along a line B-B' in FIG. 2 according to an example. FIG. 4 is a plan view of a plate heater according to an example.

Referring to FIGS. 1 to 4, a fuser 1 includes a flexible fixing belt 10, a backup member 30 located outside the fixing belt 10 to form a fixing nip 20, a heater substrate 100, and a heat conduction member 200. A plate heater 2 includes the heater substrate 100 and the heat conduction member 200.

The heater substrate 100 includes a first surface 101 on which a heating element pattern 110 is formed and a second surface 102 opposite to the first surface 101 to heat the fixing belt 10 in the fixing nip 20. The heat conduction member 200 includes a plurality of heat conduction segments contacting the first surface 101 of the heater substrate 100, the heat conduction segments being apart from each other in a long side direction LD. Here, the long side direction LD is a width direction of the fixing belt 10, and the short side direction SD is a running direction of the fixing belt 10. A length of the long side direction LD of the heater substrate 100 may be greater than a width of the fixing belt 10.

Among the plurality of heat conduction segments, a first heat conduction segment 210 and a second heat conduction segment 220 adjacent to each other may be provided with a first boundary portion 211 and a second boundary portion 221 apart from each other in the long side direction LD, respectively. The first heat conduction segment 210 may extend from the first boundary portion 211 in the long side direction LD, and the second heat conduction segment 220 may extend in a direction opposite to the direction of the first heat conduction segment 210 from the second boundary portion 221 facing the first boundary portion 211. The first boundary portion 211 and the second boundary portion 221 may overlap each other in a short side direction SD.

The heater substrate 100 may be located inside the fixing belt 10 to heat the fixing belt 10. The backup member 30 may be located outside the fixing belt 10 to face the heater substrate 100. A pressing member 40 may provide a pressing force to the heater substrate 100 or the backup member 30. The heater substrate 100 and the backup member 30 may be pressed toward each other by a pressing force of the pressing member 40 to form the fixing nip 20. The heater substrate 100 is to heat the fixing belt 10 at the fixing nip 20. As the print medium P with a toner image T formed on the surface passes through the fixing nip 20, the toner image T may be fixed to the print medium P by heat and pressure.

The fixing belt 10 may include a flexible base layer (not shown). The base layer may include a thin metal film such as stainless steel, nickel, nickel copper, or the like. The base layer may include a polymer film having heat resistance and abrasion resistance that may withstand a fixing temperature, such as a polyimide film, a polyamide film, a polyimideamide film, or the like. A release layer (not shown) may be provided on one side of the base layer facing the backup member 30 or on both sides of the base layer. The release layer may include a resin layer having a separation capability. The release layer may include, for example, perfluoroalkyl (PFA), polytetrafluoroethylene (PTFE), fluorinated ethylene propylene (FEP), or the like. To provide a relatively wide and flat fixing nip 20, an elastic layer (not shown) may be located between the base layer and the release layer. The elastic layer may include a material having heat resistance capable of withstanding a fixing temperature. For example, the elastic layer may include a rubber material such as fluorine rubber, silicone rubber, or the like.

The backup member 30 may be in the form of a roller to run the fixing belt 10 by being pressed against the heater substrate 100 and rotated with the fixing belt 10 therebetween. For example, the backup member 30 may include a core 31 extending in the long side direction LD and an elastic layer 32 provided on an outer circumference of the core 31. The core 31 may be implemented by, for example, a metal shaft, a metal cylinder, or the like. As an example, the elastic layer 32 may include a material such as rubber, thermoplastic elastomer, or the like. A release layer (not shown) may be further provided on an outer surface of the elastic layer 32. The release layer may include PFA, PTFE, FEP, or the like.

The pressing member 40 may, for example, provide a pressing force toward the backup member 30 to the heater substrate 100. As an example, the pressing member 40 may provide a pressing force to a heater holder 50 supporting the heater substrate 100, or a pressing bracket 60 connected to the heater holder 50. A structure for providing a pressing force to the heater substrate 100 is not limited to the structure shown in FIG. 1.

Referring to FIGS. 2 and 3, the heater substrate 100 may be a heat conduction substrate. For example, the heater substrate 100 may include a ceramic substrate. As a ceramic material, for example, alumina ($Al_2O_3$), aluminum nitride (AlN), or the like may be used. The heater substrate 100 includes the first surface 101 and the second surface 102. The heating element pattern 110, a common electrode 120, and a driving electrode 130 may be provided on the first surface 101 of the heater substrate 100. The heating element pattern 110 is to receive electric energy and generate heat. The heating element pattern 110 may include, for example, a metal heating material such as a silver-palladium (Ag—Pd) alloy. The common electrode 120 and the driving electrode 130 may be, for example, silver-tungsten (Ag—Pt) electrodes, silver (Ag) electrodes, or the like. In an example, a pair of heating element patterns 110 apart from each other in the short side direction SD and a pair of driving electrodes 130 respectively connected to the pair of heating element patterns 110 are employed. A pair of driving power supply terminals 106 may be respectively connected to the pair of driving electrodes 130. Although not illustrated in the drawings, a common terminal connected to the common electrode 120 may be further provided on the heater substrate 100. In an example, the pair of heating element patterns 110 may be individually driven.

An electrical insulating layer 103 may be provided on the first surface 101 of the heater substrate 100. The electrical insulating layer 103 may cover the heating element pattern 110, the common electrode 120, and the driving electrode 130. The electrical insulating layer 103 may function as a protective layer that protects the heating element pattern 110, the common electrode 120, and the driving electrode 130. The electrical insulating layer 103 may be, for example, a glass layer. The second surface 102 of the heater substrate 100 faces the fixing belt 10. The second surface 102 is to make contact with the fixing belt 10. To reduce wear of the heater substrate 100 or wear of the fixing belt 10, an anti-wear layer 104 may be provided on the second surface 102. The anti-wear layer 104 may include a material having a small coefficient of friction. The anti-wear layer 104 may be, for example, a glass layer.

When power, for example, AC power is supplied to the heating element pattern 110, heat is generated. The heater substrate 100 is heated by the heat generated by the heating element pattern 110. The total length of the heater substrate 100 is greater than a length L1 of an effective area through which the print medium P passes. The length L1 of the effective area is greater than a maximum width of the print medium P that may be fixed. An area corresponding to at least the effective length L1 of the heater substrate 100 may be heated to a uniform temperature.

In order for the heater substrate 100 to be heated to a uniform temperature, heat generated in the heating element pattern 110 may be quickly and evenly transmitted to the entire heater substrate 100. The heating element pattern 110 may have various shapes such as a solid pattern extending in the long side direction LD, a plurality of solid patterns intermittently arranged in the long side direction LD, or the like. A length of the short side direction SD of the heating element pattern 110 is less than a length of the short side direction SD of the heater substrate 100. Accordingly, an area (i.e., a heating area) in which the heating element pattern 110 is formed in the heater substrate 100 is heated by the heating element pattern 110, and an area (i.e., a non-heating area) in which the heating element pattern 110 is not formed in the heater substrate 100 is heated by heat transferred from the heating area.

The time (i.e., initial printing time) until the first printing is possible after turning on the power of a printer depends on the time at which a temperature of the heater substrate 100 reaches a fixing temperature, for example, 80° C. to 150° C. To this end, high power may be supplied to the heating element pattern 110. In that case, a temperature of a heating area of the heater substrate 100 may be excessively high and heat stress may be applied to the heater substrate 100. When the heat stress is accumulated in the heater substrate 100, the heater substrate 100 may be damaged.

In this regard, the fuser 1 may include the heat conduction member 200 contacting the first surface 101 of the heater substrate 100. Here, "contacting the first surface 101 of the heater substrate 100" means that the heat conduction member 200 contacts the outermost surface of the heater substrate 100 on which the heating element pattern 110 is formed. In an example, the heat conduction member 200 is in contact with the electrical insulating layer 103 covering the heating element pattern 110. When there is another material layer outside the electrical insulating layer 103, the heat conduction member 200 may contact the material layer. The heat conduction member 200 may be adhered to the first surface 101 of the heater substrate 100 by a heat conduction adhesive. The heat conduction member 200 may be fixed to the first surface 101 of the heater substrate 100 by a fixing member (not shown). The heat conduction member 200 may be placed on the first surface 101 of the heater substrate 100 and may be pressed toward the first surface 101 by, for example, the heater holder 50 or another member.

The heat conduction member 200 may include a material having a high thermal conductivity, such as a thin metal sheet of aluminum, a graphite sheet, or the like. A heat capacity of the heat conduction member 200 is less than that of the heater substrate 100. The heat capacity of the heat conduction member 200 may be adjusted by size. For example, by reducing a thickness of the heat conduction member 200, the heat conduction member 200 having a small heat capacity may be implemented. The thickness of the heat conduction member 200 may be less than the thickness of the heater substrate 100. The thickness of the heat conduction member 200 may be less than or equal to half the thickness of the heater substrate 100. For example, the thickness of the heat conduction member 200 may be about 30 μm to about 500 μm. A length L2 of the heat conduction member 200 may be equal to or greater than the length L1 of the effective area of the heater substrate 100 through which the print medium P passes.

Heat generated in the heating element pattern 110 may be transferred to the heater substrate 100 and the heat conduction member 200. Because a portion of heat generated in the heating element pattern 110 is rapidly transferred to the heat conduction member 200, overheating of the heating area of the heater substrate 100 may be reduced or prevented. In addition, the heater substrate 100 may be rapidly and evenly heated as a whole by heat transferred in the long side direction LD and the short side direction SD along the heat conduction member 200. Therefore, the temperature of the heater substrate 100 may be increased to the fixing temperature at a rapid rate as a whole.

The heat conduction member 200 may be deformed by repeated expansion and contraction as heating and cooling are repeated. In this regard, the heat conduction member 200 may include two or more heat conduction segments that are apart from each other in the long side direction LD. Hereinafter, a description will be given of an example heat conduction member 200 having two heat conduction segments. In other examples, the heat conduction member 200 may be provided with three or more heat conduction segments in consideration of a length of the long side direction LD of the heater substrate 100, a thermal expansion coefficient of the heat conduction member 200, assembly characteristics, or the like.

As an example, referring to FIG. 4, the heat conduction member 200 may include the first heat conduction segment 210 and the second heat conduction segment 220. The first heat conduction segment 210 and the second heat conduction segment 220 are apart from each other in the long side direction LD. The first heat conduction segment 210 extends from the first boundary portion 211 in the long side direction LD, and the second heat conduction segment 220 extends in a direction opposite to the direction of the first heat conduction segment 210 from the second boundary portion 221 facing the first boundary portion 211. The first boundary portion 211 and the second boundary portion 221 are apart from each other in the long side direction LD. According to such a configuration, heat generated from the heating element pattern 110 is rapidly propagated in both directions in the long side direction LD along the first heat conduction segment 210 and the second heat conduction segment 220. Therefore, overheating of the heating area in the heater substrate 100 may be reduced or prevented, and the heater substrate 100 may be rapidly heated to a uniform temperature as a whole. In addition, since the first boundary portion 211 and the second boundary portion 221 are apart from each other, even if the first heat conduction segment 210 and the second heat conduction segment 220 are expanded, an area between the first boundary portion 211 and the second boundary portion 221 acts as a buffer so that deformation of the first heat conduction segment 210 and the second heat conduction segment 220 may be reduced or prevented.

An area 105 between the first boundary portion 211 and the second boundary portion 221 of the heater substrate 100 is a non-contact area that does not contact the heat conduction member 200. Therefore, when the heating element pattern 110 is present in the non-contact area, a temperature of the non-contact area of the heater substrate 100 may be relatively higher than a temperature of a contact area of the heater substrate 100 in contact with the heat conduction member 200.

In the described example, the first boundary portion 211 of the first heat conduction segment 210 and the second boundary portion 221 of the second heat conduction segment 220 overlap each other in the short side direction SD. The overlapping of the first boundary portion 211 and the second boundary portion 221 in the short side direction SD means that, for example, a line CL1 in the short side direction SD passing through a portion of the first boundary portion 211 closest to the second boundary portion 221 intersects the second boundary portion 221, and a line CL2 in the short side direction SD passing through a portion of the second boundary portion 221 closest to the first boundary portion 211 intersects the first boundary portion 211. According to such a configuration, heat of the non-contact area may be rapidly transferred to the first heat conduction segment 210 and the second heat conduction segment 220 in the long side direction LD and the short side direction SD, so that overheating of the non-contact area may be reduced or prevented.

In an example as shown in FIG. 4, the first boundary portion 211 and the second boundary portion 221 overlapping each other in the short side direction SD are implemented by the first boundary portion 211 and the second boundary portion 221 in a diagonal shape inclined at the same angle with each other.

Table 1 shows results of heating the fixing belt 10 using a plate heater 2 having a structure (e.g., a first structure) in which the first boundary portion 211 and the second boundary portion 221 do not overlap each other in the short-side direction SD and results of heating the fixing belt 10 using a plate heater 2 having a structure (e.g., a second structure) in which the first boundary portion 211 and the second boundary portion 221 overlap in the short-side direction SD by measuring a surface temperature of the fixing belt 10. In Table 1, T2 is temperature of a center of the fixing belt 10 in a width direction, and T1 and T3 are temperatures of both ends in the width direction. ΔT is a temperature difference between the center and both ends of the fixing belt 10, and is a value calculated by T2−(T1+T3)/2.

TABLE 1

| | The number of prints | T1 (° C.) | T2 (° C.) | T3 (° C.) | ΔT (° C.) | Glossiness evaluation |
|---|---|---|---|---|---|---|
| First structure | 1-5 | 182 | 188 | 184 | 5 | ○ |
| | 6-20 | 184 | 190 | 186 | 5 | ○ |
| | 21-50 | 184 | 192 | 186 | 7 | Δ |
| | 51-100 | 185 | 194 | 186 | 8.5 | x |
| | 101-150 | 185 | 195 | 186 | 9.5 | x |
| Second structure | 1-5 | 184 | 186 | 185 | 1.5 | ○ |
| | 6-20 | 184 | 187 | 185 | 2.5 | ○ |
| | 1-50 | 185 | 188 | 186 | 2.5 | ○ |
| | 1-100 | 185 | 189 | 187 | 3 | ○ |
| | 01-150 | 185 | 189 | 187 | 3 | ○ |

Figure 5:
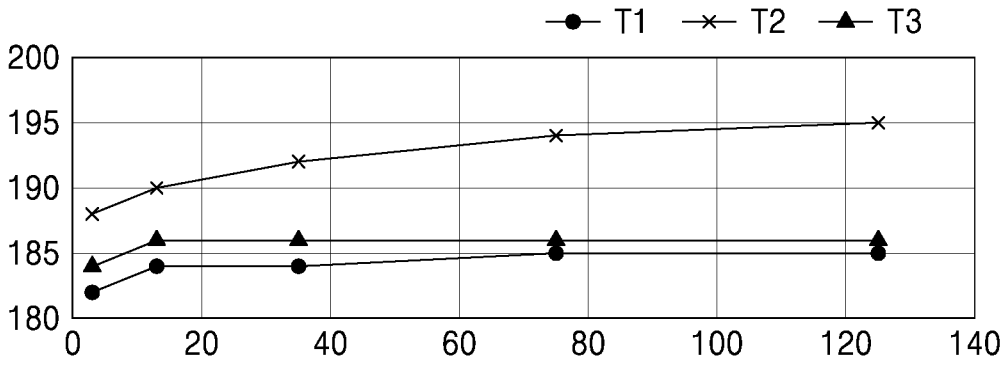
FIG. 5 is a graph showing a result of measuring a temperature of a fixing belt according to a number of prints when a first structure is employed according to an example.
Figure 6:
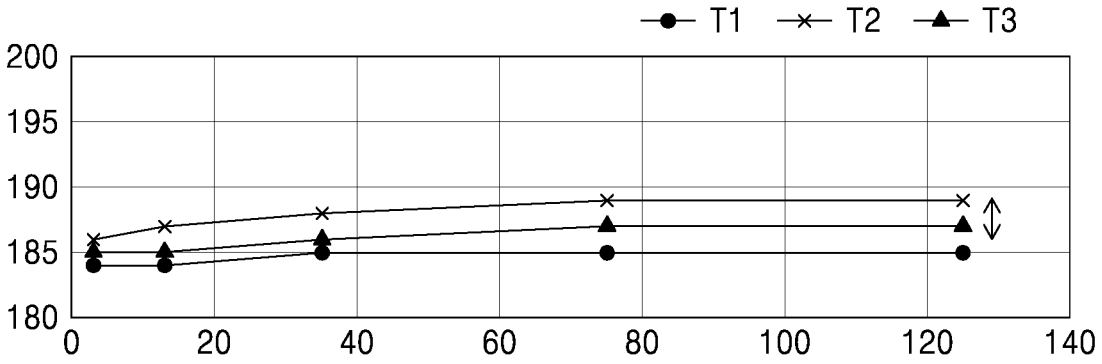
FIG. 6 is a graph showing a result of measuring a temperature of a fixing belt according to a number of prints when a second structure is employed according to an example.

FIG. 5 is a graph showing a result of measuring a temperature of a fixing belt according to a number of prints when a first structure is employed according to an example. FIG. 6 is a graph showing a result of measuring a temperature of a fixing belt according to a number of prints when a second structure is employed according to an example. In FIGS. 5 and 6, a horizontal axis represents the number of prints, and a vertical axis represents a temperature of the fixing belt 10. Also in FIGS. 5 and 6, the references T1, T2, and T3 refer to T1, T2, and T3 in Table 1, respectively.

Referring to Table 1 and FIG. 5, T2 is higher than T1 and T3. This is because in the structure in which the first boundary portion 211 and the second boundary portion 221 do not overlap each other in the short side direction SD, heat of a non-contact area between the first boundary portion 211 and the second boundary portion 221 is not transmitted to the first and second heat conduction segments 210 and 220. As the number of prints increases, T2 increases faster than T1 and T3, and ΔT increases rapidly. When ΔT is increased as described above, a difference between the glossiness of a center of a fixed image and the glossiness of both sides of the fixed image is large, and a band-shaped glossiness irregularity in the short side direction SD appears in the center of the fixed image.

Referring to Table 1 and FIG. 6, T2 is higher than T1 and T3. However, ΔT is half or less as compared to when the first structure is employed, and ΔT is maintained at 3° C. or less even if 150 sheets are continuously printed. This is because the first boundary portion 211 and the second boundary portion 221 overlap each other in the short-side direction SD and heat of the non-contact area between the first boundary portion 211 and the second boundary portion 221 is rapidly transferred to the first and second heat conduction segments 210 and 220. Therefore, there is little difference in glossiness between the center and both sides of the fixed image, so there is no glossiness irregularity on the fixed image.

Referring to Table 1 and FIGS. 5 and 6, the temperatures T1 and T3 at both ends of the fixing belt 10 are not the same. That is, T1 is lower than T3. One of the reasons why the temperatures T1 and T3 at both ends of the fixing belt 10 are not the same is asymmetry of the backup member 30 in the long side direction LD.

Figure 7:
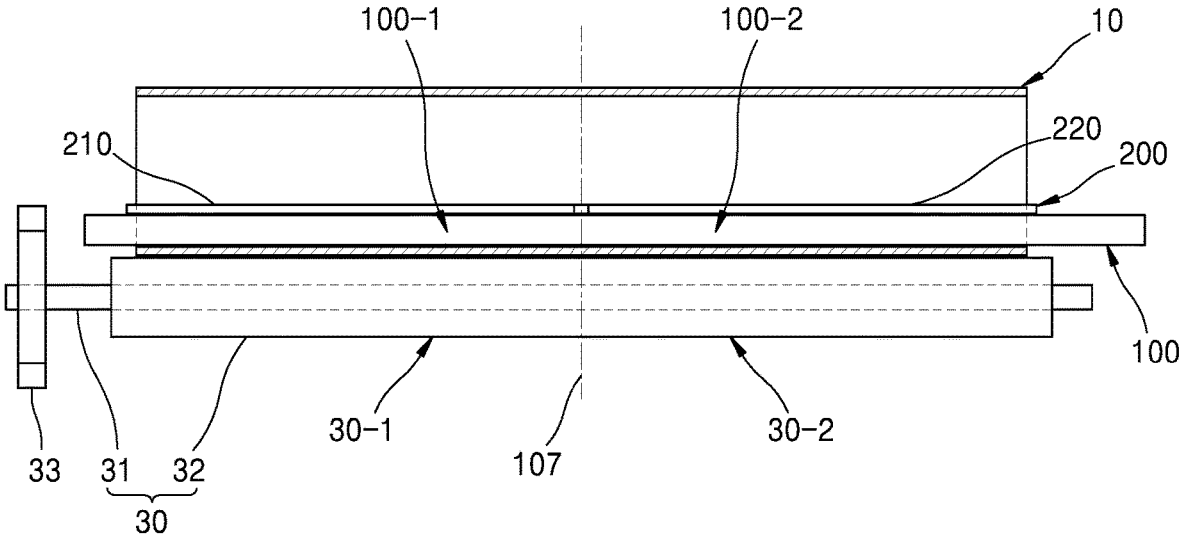
FIG. 7 is a cross-sectional view of the fuser taken along a line A-A' of FIG. 1 according to an example.

FIG. 7 is a cross-sectional view of the fuser taken along a line A-A' in FIG. 1 according to an example.

Referring to FIG. 7, the backup member 30 is asymmetrical in the long side direction LD based on a central portion 107 of an effective area of the heater substrate 100. In the backup member 30 of FIG. 7, a length of a first side 30-1, that is, a length of a side on which the first heat conduction segment 210 is located, is greater than a length of a second side 30-2, that is, a length of a side where the second heat conduction segment 220 is located. This is because the core 31 is extended longer to the first side 30-1 than the second side 30-2 to install a power connection structure such as a gear 33 for rotating the backup member 30 on the first side 30-1. The backup member 30 faces the fixing belt 10 with the print medium P therebetween. Heat of the fixing belt 10 is also transferred to the backup member 30. Here, due to the asymmetry of the backup member 30, the amount of heat transferred from both sides of the fixing belt 10 to the backup member 30 may be different. T1 is lower than T3 because more heat is dissipated from the fixing belt 10 to the first side 30-1 of the backup member 30.

A reason why the temperatures T1 and T3 at both ends of the fixing belt 10 are not the same is asymmetry of the fuser 1 in the long side direction LD. For example, referring to FIG. 7, the heater substrate 100 is asymmetrical in the long side direction LD based on the central portion 107 of the effective area of the heater substrate 100. In the heater substrate 100 of FIG. 7, a length of a first side 100-1, that is, a length of a side on which the first heat conduction segment 210 is located, is less than a length of a second side 100-2, that is, a length of a side where the second heat conduction segment 220 is located. This is because a power supply terminal 106 for supplying power to the common electrode 120 and the driving electrode 130 is installed on the second side 100-2.

When the heater substrate 100 and the backup member 30 are asymmetrical to the long side direction LD based on the central portion 107 of the effective area of the heater substrate 100, asymmetric directions of the heater substrate 100 and the backup member 30 may be made to be in opposite directions. For example, in the heater substrate 100, the length of the first side 100-1 may be less than the length of the second side 100-2 in the long side direction LD based on the central portion 107 of the effective area of the heater substrate 100. In contrast, in the backup member 30, a length of the first side 30-1 may be greater than a length of the second side 30-2 in the long side direction LD based on the central portion 107 of the effective area of the heater substrate 100. With this configuration, a difference between the temperatures T1 and T3 on both sides of the fixing belt 10 may be reduced, and a difference in overall glossiness of the fixed image may be reduced.

Figure 8:
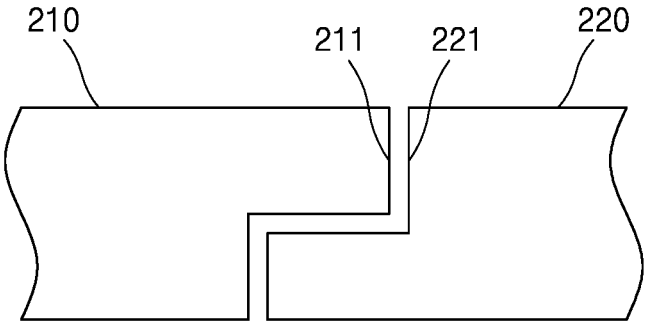
FIGS. 8 to 10 illustrate a first boundary portion and a second boundary portion overlapping in a short side direction according to various examples.
Figure 9:
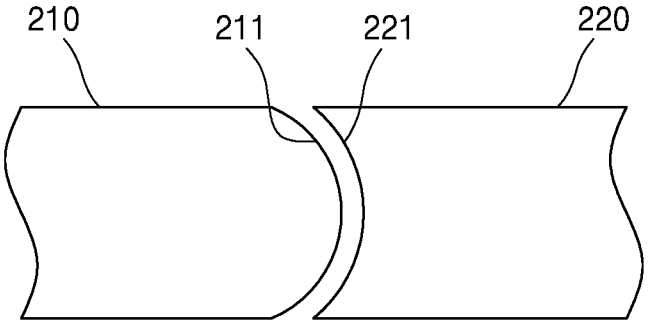
Figure 10:
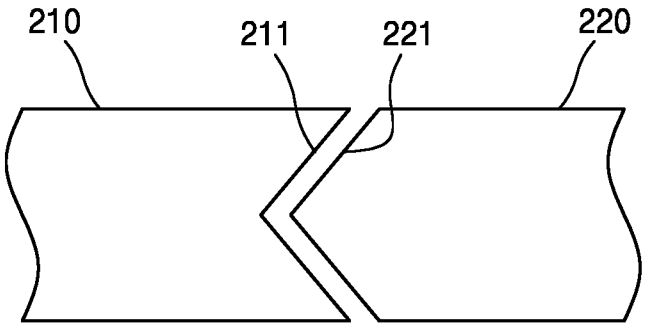

The first boundary portion 211 and the second boundary portion 221 overlapping in the short side direction SD may be implemented in various forms. For example, the first boundary portion 211 and the second boundary portion 221 may have complementary concave and convex shapes. FIGS. 8 to 10 illustrate a first boundary portion and a second boundary portion overlapping in a short side direction SD according to various examples. As illustrated in FIG. 8, the first boundary portion 211 and the second boundary portion 221 may have complementary stepped shapes overlapping in the short side direction SD. As illustrated in FIG. 9, the first boundary portion 211 and the second boundary portion 221 may have complementary arc shapes overlapping in the short side direction SD. As illustrated in FIG. 10, the first boundary portion 211 and the second boundary portion 221 may have complementary wedge shapes overlapping in the short side direction SD. In addition to this, as described in FIG. 4, the first and second boundary portions 211 and 221 may be implemented by various shapes satisfying a condition in which the line CL1 in the short side direction SD passing through a portion of the first boundary portion 211 closest to the second boundary portion 221 intersects the second boundary portion 221 and the line CL2 in the short side direction SD passing through a portion of the second boundary portion 221 closest to the first boundary portion 211 intersects the first boundary portion 211.

Figure 11:
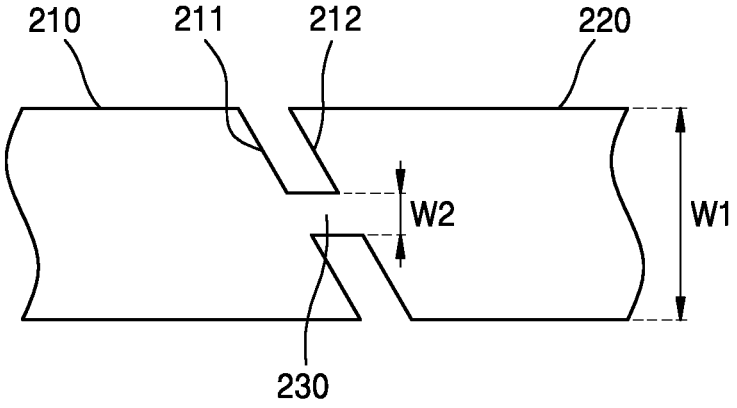
FIG. 11 is a plan view of a heat conduction member according to an example.

FIG. 11 is a plan view of a heat conduction member according to an example. As described above, members forming the fuser 1 may have asymmetry in the long side direction LD. Due to this asymmetry, the temperature of the fixing belt 10 or the temperature of the heater substrate 100 may be uneven in the long side direction LD. As an example for alleviating temperature unevenness due to asymmetry, referring to FIG. 11, the first heat conduction segment 210 and the second heat conduction segment 220 may be connected to each other by a bridge 230 partially connecting the first boundary portion 211 to the second boundary portion 221.

Heat exchange is possible between the first heat conduction segment 210 and the second heat conduction segment 220 by the bridge 230. Therefore, unevenness of the temperature of the fixing belt 10 or the temperature of the heater substrate 100 due to asymmetry of the members forming the fuser 1 in the long side direction LD may be reduced or alleviated. The bridge 230 may contact a non-contact portion of the heater substrate 100, that is, the area between the first boundary portion 211 and the second boundary portion 221.

Accordingly, heat of the non-contact portion of the heater substrate 100 or heat of the heating element pattern 110 provided in the non-contact portion may be effectively transferred to the first and second heat conduction segments 210 and 220 through the bridge 230. Therefore, overheating of the non-contact portion of the heater substrate 100 may be reduced or prevented, and a difference in temperature between the center and both ends of the fixing belt 10 may be reduced or alleviated. In addition, because the first heat conduction segment 210 and the second heat conduction segment 220 may be treated as a single component, assembly characteristics of the plate heater 2 or the fuser 1 may be improved.

In order to accommodate a change in length due to thermal expansion of the first and second heat conduction segments 210 and 220 while the first boundary portion 211 and the second boundary portion 221 are apart from each other, the bridge 230 partially connects the first boundary portion 211 to the second boundary portion 221. A width W2 of the bridge 230 may be less than a width W1 of the first and second heat conduction segments 210 and 220. For example, the width W2 of the bridge 230 may be half or less than the width W1 of the first and second heat conduction segments 210 and 220.

The bridge 230 may connect the first boundary portion 211 to the second boundary portion 221 in at least one of the long side direction LD and the short side direction SD. FIG. 11 shows one bridge 230 connecting the first boundary portion 211 and the second boundary portion 221 in a diagonal shape in the long side direction LD. However, the first and second boundary portions 211 and 221 may be connected to each other by two or more bridges 230 depending on necessity or the shapes of the first and second boundary portions 211 and 221. FIGS. 12 to 15 illustrate forms of a bridge according to various examples.

Figure 12:
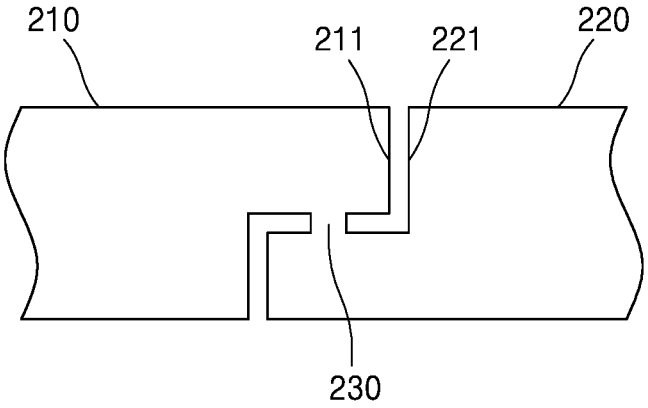
FIGS. 12 to 15 illustrate forms of a bridge according to various examples.
Figure 13:
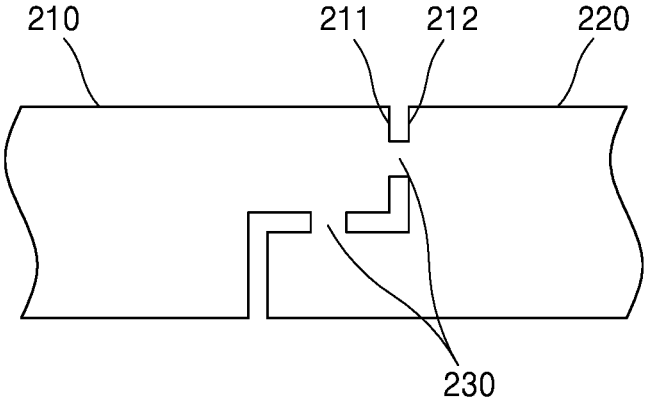

As illustrated in FIG. 12, the first boundary portion 211 and the second boundary portion 221 may have complementary stepped shapes overlapping in the short side direction SD. The bridge 230 may connect the first boundary portion 211 to the second boundary portion 221 in the short side direction LD. As illustrated in FIG. 13, the first boundary portion 211 and the second boundary portion 221 may be connected to each other in the long side direction LD and the short side direction SD by two bridges 230, respectively.

Figure 14:
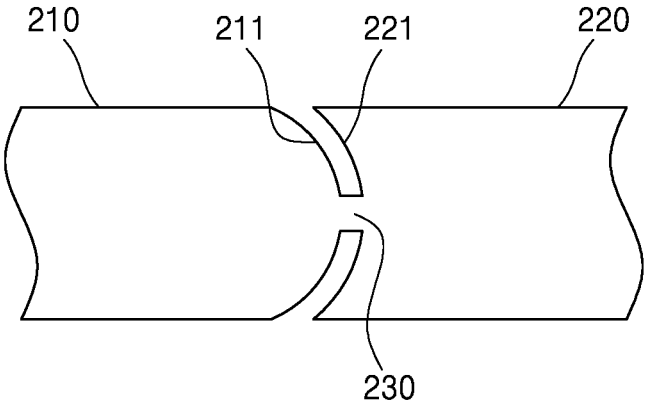
Figure 15:
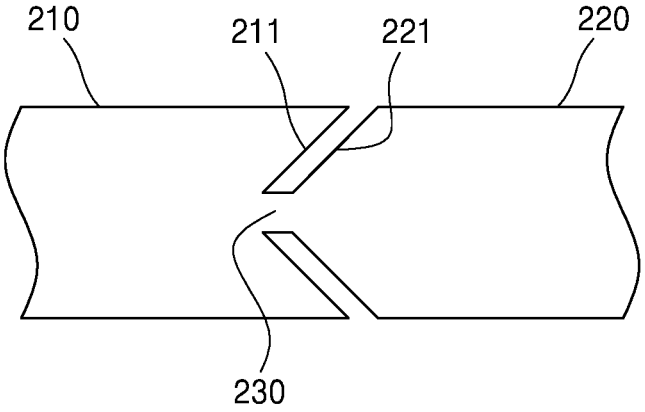

As illustrated in FIG. 14, the first boundary portion 211 and the second boundary portion 221 may have complementary arc shapes overlapping in the short side direction SD. The bridge 230 may connect the first boundary portion 211 to the second boundary portion 221 in the long side direction LD. As illustrated in FIG. 15, the first boundary portion 211 and the second boundary portion 221 may have complementary wedge shapes overlapping in the short side direction SD. The bridge 230 may connect the first boundary portion 211 to the second boundary portion 221 in the long side direction LD.

It should be understood that examples described herein should be considered in a descriptive sense only and not for purposes of limitation. Descriptions of features or aspects within each example should typically be considered as available for other similar features or aspects in other examples. While examples have been described with reference to the figures, it will be understood by those of ordinary skill in the art that various changes in form and details may be made therein without departing from the spirit and scope as defined by the following claims.

What is claimed is:

1. A fuser comprising:

a flexible fixing belt;

a backup member to form a fixing nip with the fixing belt;

a heater substrate having a first surface on which a heating element pattern is located and a second surface opposite to the first surface, the heater substrate to heat the fixing belt at the fixing nip; and a heat conduction member having a plurality of heat conduction segments contacting the first surface of the heater substrate, the plurality of heat conduction segments being apart from each other in a long side direction, wherein, among the plurality of heat conduction segments, a first heat conduction segment and a second heat conduction segment adjacent to each other are provided with a first boundary portion and a second boundary portion apart from each other in the long side direction, respectively, wherein the first heat conduction segment and the second heat conduction segment are connected to each other by a bridge partially connecting the first boundary portion to the second boundary portion.

2. The fuser of claim 1, wherein the first heat conduction segment extends from the first boundary portion in the long side direction, wherein the second heat conduction segment extends in a direction opposite to the direction of the first heat conduction segment from the second boundary portion facing the first boundary portion, and wherein the first boundary portion and the second boundary portion overlap each other in a short side direction.

3. The fuser of claim 1, wherein the first boundary portion and the second boundary portion have diagonal shapes or complementary shapes.

4. The fuser of claim 1, wherein a width of the bridge is equal to or less than half a width of the first heat conduction segment and the second heat conduction segment.

5. The fuser of claim 1, wherein the first boundary portion and the second boundary portion have diagonal shapes, and wherein the bridge connects the first boundary portion to the second boundary portion in the long side direction.

6. The fuser of claim 1, wherein the first boundary portion and the second boundary portion have complementary stepped shapes, and wherein the bridge connects the first boundary portion to the second boundary portion in at least one of the long side direction and the short side direction.

7. The fuser of claim 1, wherein the heater substrate or the backup member is asymmetrical in the long side direction with a central portion of an effective area of the heater substrate as the center.

8. The fuser of claim 7, wherein a length of a first side of the heater substrate is less than a length of a second side of the heater substrate in the long side direction with respect to the central portion, and wherein a length of the first side of the backup member is greater than a length of the second side of the backup member in the long side direction with respect to the central portion.

9. A plate heater comprising:

a heater substrate having a first surface on which a heating element pattern is located and a second surface opposite to the first surface; and a heat conduction member having a plurality of heat conduction segments contacting the first surface of the heater substrate, the plurality of heat conduction segments being apart from each other in a long side direction, wherein, among the plurality of heat conduction segments, a first heat conduction segment and a second heat conduction segment adjacent to each other are provided with a first boundary portion and a second boundary portion apart from each other in the long side direction, respectively, wherein the first heat conduction segment and the second heat conduction segment are connected to each other by a bridge partially connecting the first boundary portion to the second boundary portion.

10. The plate heater of claim 9, wherein the first heat conduction segment extends from the first boundary portion in the long side direction, wherein the second heat conduction segment extends in a direction opposite to the direction of the first heat conduction segment from the second boundary portion facing the first boundary portion, and wherein the first boundary portion and the second boundary portion overlap each other in a short side direction.

11. The plate heater of claim 9, wherein the first boundary portion and the second boundary portion have diagonal shapes or complementary shapes.

12. The plate heater of claim 9, wherein a width of the bridge is equal to or less than half a width of the first heat conduction segment and the second heat conduction segment.

13. The plate heater of claim 9, wherein the heater substrate is asymmetrical in the long side direction with a central portion of an effective area of the heater substrate as the center.

* * * * *